US009111511B2

(12) United States Patent
Miller

(10) Patent No.: US 9,111,511 B2
(45) Date of Patent: Aug. 18, 2015

(54) GUITAR BACK PLATE

(71) Applicant: Michael Scott Miller, Durham, NC (US)

(72) Inventor: Michael Scott Miller, Durham, NC (US)

( * ) Notice: Subject to any disclaimer, the term of this patent is extended or adjusted under 35 U.S.C. 154(b) by 0 days.

(21) Appl. No.: 14/264,911

(22) Filed: Apr. 29, 2014

(65) Prior Publication Data

US 2014/0345438 A1 Nov. 27, 2014

Related U.S. Application Data

(60) Provisional application No. 61/816,890, filed on Apr. 29, 2013.

(51) Int. Cl.
*G10D 3/02* (2006.01)
*G10D 1/08* (2006.01)

(52) U.S. Cl.
CPC . *G10D 3/02* (2013.01); *G10D 1/085* (2013.01)

(58) Field of Classification Search
CPC ..... G10D 1/08
USPC ..... 84/267, 290, 291, 293
See application file for complete search history.

(56) References Cited

U.S. PATENT DOCUMENTS 5,857,763 A * 1/1999 Chen ..... 362/140
2004/0182984 A1* 9/2004 Sandkuhl ..... 248/443

* cited by examiner

*Primary Examiner* — Kimberly Lockett

(57) ABSTRACT

A back plate attachable to the back of a guitar is provided. The plate includes screw holes and string ferrule holes. The screw holes of the plate align with the screw holes on a guitar, and the string ferrule holes of the plate align with the string ferrule holes of the guitar. The plate may be bolted or screwed to the back of the guitar via the screw holes. Guitar strings may run through the string ferrule holes of the plate and guitar and attach to the pegs of the guitar.

8 Claims, 2 Drawing Sheets

GUITAR BACK PLATE

CROSS-REFERENCE TO RELATED APPLICATION

This application claims the benefit of priority of U.S. provisional application No. 61/816,890, filed Apr. 29, 2013, the contents of which are herein incorporated by reference.

BACKGROUND OF THE INVENTION

The present invention relates to a guitar back plate and, more particularly, to a guitar back plate for improving the resonance of the guitar.

A guitar is a popular musical instrument that makes sound by the playing of its (typically) six strings with the sound being projected either acoustically or through electrical amplification. Currently, a large amount of electric guitars lack resonance as a result of being made from inferior materials. All of the separate elements of the guitar function independently, which dampens the natural resonance of the electric guitar.

As can be seen, there is a need for a device that improves the resonance of the guitar.

SUMMARY OF THE INVENTION

In one aspect of the present invention, a guitar back attachment comprises: a plate comprising a top surface and a bottom surface, wherein the plate comprises a plurality of plate screw holes formed to align with a plurality of guitar screw holes used to join a neck of a guitar to a body of the guitar, wherein the plate further comprises a plurality of plate ferrule holes formed to align with a plurality of guitar ferrule holes through the body of the guitar.

In another aspect of the present invention, a guitar comprises: a body portion comprising a front surface and a back surface, and comprising a plurality of guitar screw holes and a plurality of guitar ferrule holes running through the front surface and the back surface; a neck portion extending from the body portion; and a plate comprising a plurality of plate screw holes formed to align with the plurality of guitar screw holes and a plurality of plate ferrule holes formed to align with the plurality of guitar ferrule holes, wherein the plate is attached to the back surface of the body portion.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a back plate attachable to the back of a guitar. The plate includes screw holes and string ferrule holes. The screw holes of the plate align with the screw holes on a guitar, and the string ferrule holes of the plate align with the string ferrule holes of the guitar. The plate may be bolted or screwed to the back of the guitar via the screw holes. Guitar strings may run through the string ferrule holes of the plate and guitar and attach to the pegs of the guitar.

The present invention includes a metal plate that bolts to the back of an electric guitar, bridging the neck mount to the string ferrules of the electric guitar. The present invention includes neck mounting holes and may replace the neck mounting plate currently attached to the guitar. The plate further includes string ferrule holes at the opposite end of the neck mounting holes. The plate may lie in contact with the back of the electric guitar and bridge the gap between the neck mount and the string ferrules. Therefore, the neck mount, the string ferules and the body may function as one vibrating entity, thereby drastically increasing the resonance.

Figure 1:
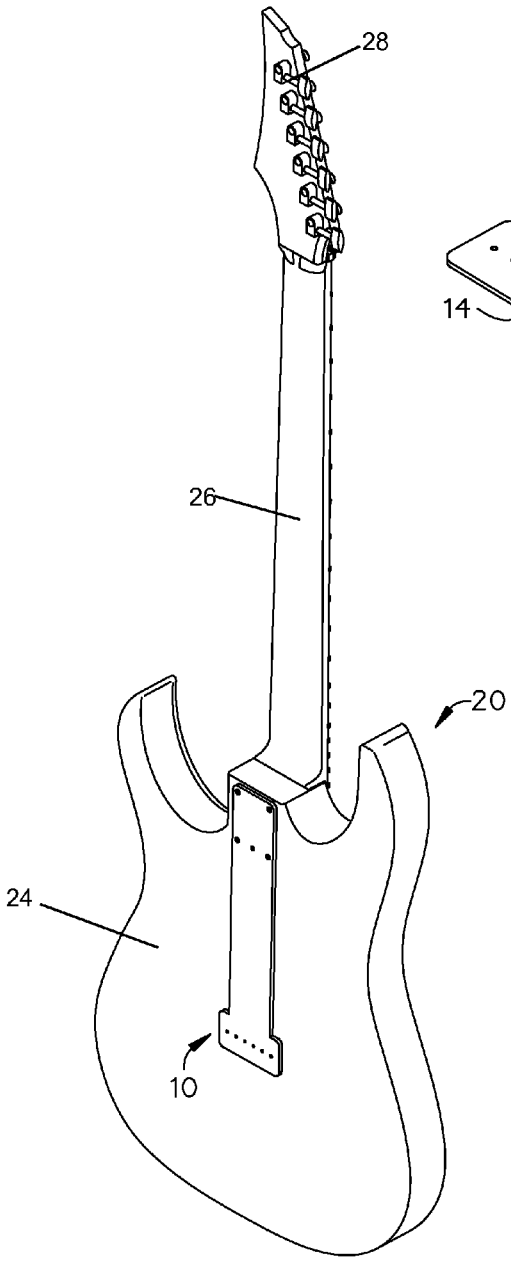
FIG. 1 is a perspective view of the present invention shown in use.
Figure 2:
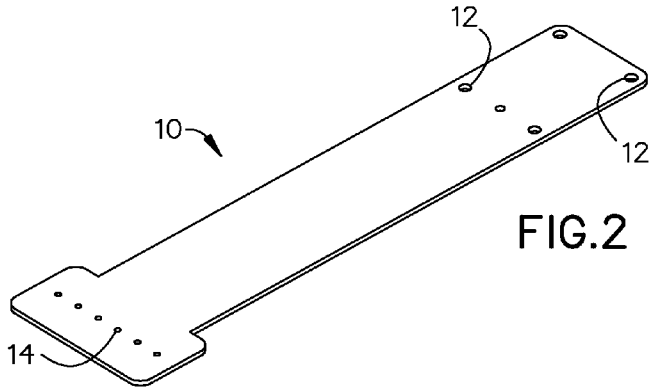
FIG. 2 is a perspective view of the present invention.
Figure 3:
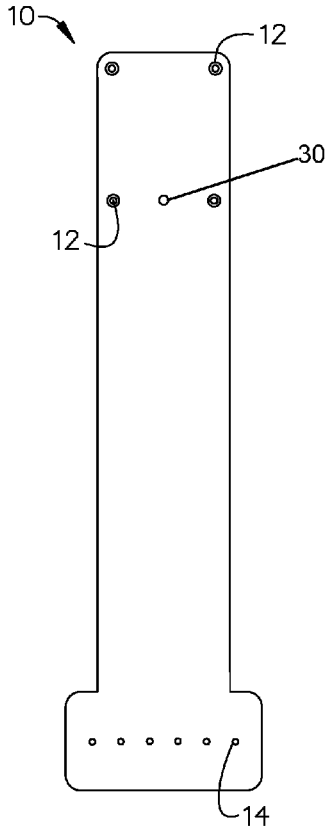
FIG. 3 is a front view of the present invention.
Figure 4:
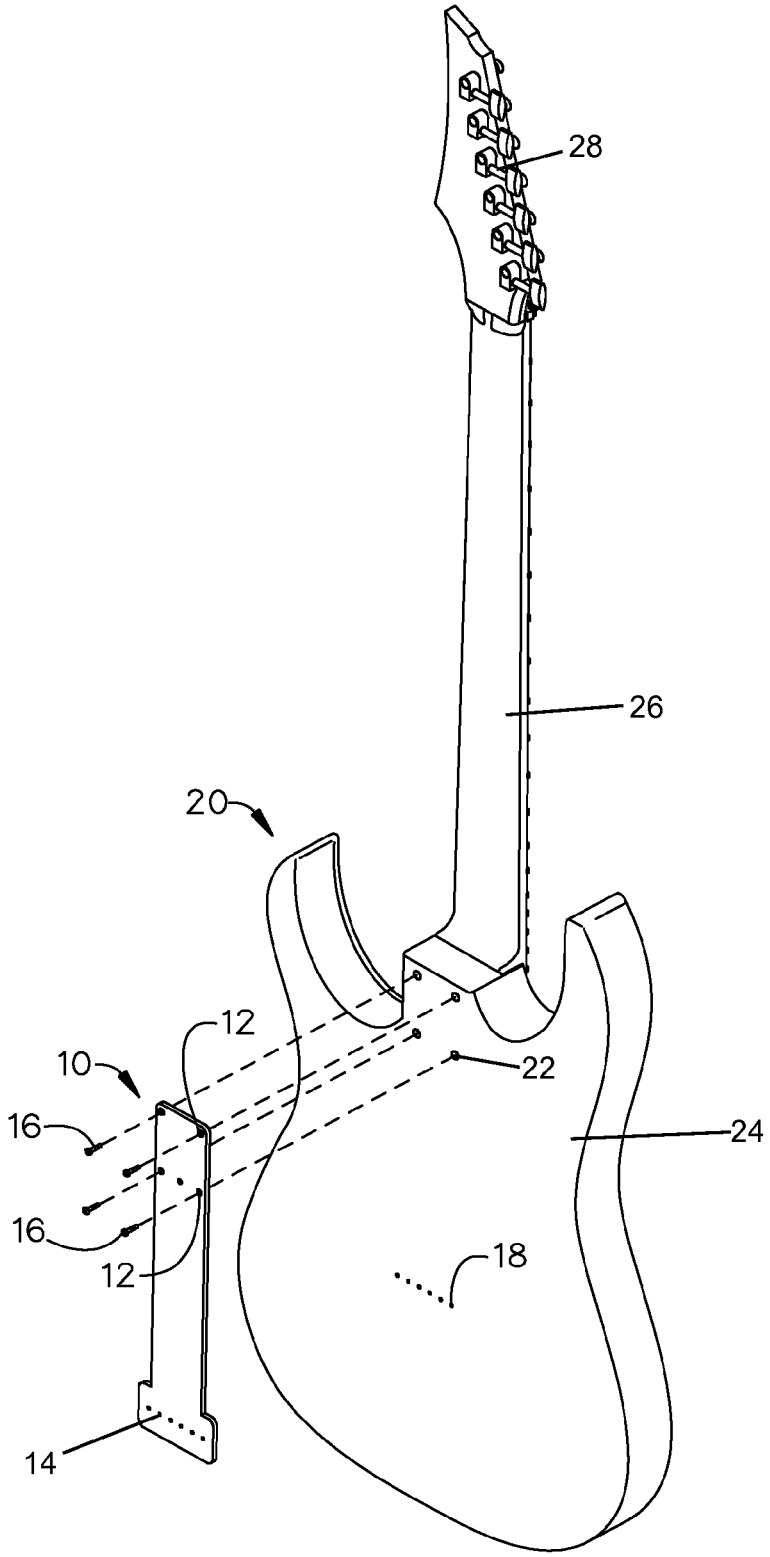
FIG. 4 is an exploded view of the present invention.

Referring to FIGS. 1 through 4, the present invention includes a guitar back attachment plate 10. The plate 10 includes a top surface and a bottom surface. The top surface may be substantially flat. A plurality of plate screw holes 12 and a plurality of plate ferrule holes 14 may run through the top surface and bottom surface of the plate 10. The plate screw holes 12 may be near a top end of the plate 10, while the plate ferrule holes 14 may be near the bottom end of the plate 10.

The plate 10 is attached to a guitar 20. The guitar 20 includes a neck portion 26 and a body portion 24 having a front surface and a back surface. The neck portion 26 is attached to the body portion 24 by a plurality of screws 16 that run through a plurality of guitar screw holes 22 in the body portion 24 and into the neck portion 26. The body portion 24 of the guitar 20 may further include a plurality of guitar ferrule holes 18 that run through the front surface and the back surface of the body portion 24.

A plurality of guitar strings may be attached to the guitar 20. The plurality guitar strings may each include a first end and a second end. The first end may include a stopper having a diameter larger than the plate and guitar ferrule holes 14, 18. The stopper may be a brass ring. The guitar strings each run through the plurality of guitar ferrule holes 18 and the second end attaches to the tuning pegs 28 so that the stoppers abut against the body portion 24 of the guitar 20.

The plate 10 is attached to the back surface of the body portion 24 of the guitar 20. The plurality of plate screw holes 12 align with the plurality of guitar screw holes 22. Screws 16 or bolts may be driven through the aligned screw holes 12, 22 and into the neck portion 26 of the guitar 20. The plurality of plate ferrule holes 14 align with the plurality of guitar ferrule holes 18. The plurality of guitar strings runs through each of the plurality of plate ferrule holes 14 and the plurality of guitar ferrule holes 18. As mentioned above, the second end attaches to the tuning pegs 28 and the strings may be tightened so that the stoppers abut against the plate 10 at the plurality of plate ferrule holes 14. The bottom surface of the plate 10 is thereby pressed against the back surface of the body portion of the guitar 20.

In certain embodiments, the guitar 20 may include a micro tilt adjustment. In such embodiments, an allen screw is used to adjust the tilt of the neck portion 26. The plate 10 of the present invention may include a micro tilt adjustment opening 30. The micro tilt adjustment opening 30 may align with the micro tilt adjustment screw of the guitar 20. Therefore, a user may adjust the tilt of the neck portion 20 with the plate 10 of the present invention attached to the back surface of the body portion of the guitar 20.

The plate 10 of the present invention may be made of a resonant material, such as metal. For example, the plate may be made of Aluminum. The present invention may be made from a single piece sized to include the neck mounting holes 12 on one end and the string ferrule holes 14 on the other. By combining both functions into one piece it increases the resonance of the guitar 20.

It should be understood, of course, that the foregoing relates to exemplary embodiments of the invention and that modifications may be made without departing from the spirit and scope of the invention as set forth in the following claims.

What is claimed is:

1. A guitar back attachment comprising:

a plate comprising a top surface, a bottom surface, a top end and a bottom end, wherein the plate comprises a plurality of plate screw holes at the top end formed to align with a plurality of guitar screw holes used to join a neck of a guitar to a body of the guitar, wherein the plate further comprises a plurality of plate ferrule holes at the bottom end formed to align with a plurality of guitar ferrule holes through the body of the guitar.

2. The guitar back of claim 1, wherein the bottom surface is substantially flat and formed to rest against a back surface of the body of the guitar.

3. The guitar back of claim 1, wherein the plate further comprises a plate micro tilt adjustment hole formed to align with a micro tilt adjustment on the back of the guitar.

4. A guitar comprising:

a body portion comprising a front surface and a back surface, and comprising a plurality of guitar screw holes and a plurality of guitar ferrule holes running through the front surface and the back surface;

a neck portion extending from the body portion; and a plate comprising a top end and a bottom end, wherein the top end comprises a plurality of plate screw holes formed to align with the plurality of guitar screw holes and the bottom end comprises a plurality of plate ferrule holes formed to align with the plurality of guitar ferrule holes, wherein the plate is attached to the back surface of the body portion.

5. The guitar of claim 4, further comprising a plurality of screws through the plurality of plate screw holes and plurality of guitar screw holes, thereby attaching the plate to the body portion.

6. The guitar of claim 4, further comprising a plurality guitar strings each comprising a first end and a second end, wherein the first end comprises a stopper comprising a diameter larger than the plate ferrule holes, wherein the plurality of guitar strings runs through each of the plurality of plate ferrule holes and the plurality of guitar ferrule holes and the second end attaches to the tuning pegs so that the stoppers abut against the plate at the plurality of plate ferrule holes.

7. The guitar of claim 6, wherein each stopper is a brass ring.

8. The guitar of claim 4, wherein the plate further comprises a plate micro tilt adjustment hole aligning with a micro tilt adjustment on the back surface of the body portion.

* * * * *